United States Patent [19]

Weremiczyk et al.

[11] 4,154,148

[45] May 15, 1979

[54] PARTITION FORMING AND INSERTING APPARATUS

[75] Inventors: Benny Weremiczyk; Wayne R. Meredith, both of Spokane, Wash.

[73] Assignee: MSG Industries, Inc., Spokane, Wash.

[21] Appl. No.: 813,478

[22] Filed: Jul. 7, 1977

[51] Int. Cl.[2] ..... B31B 1/00

[52] U.S. Cl. ..... 93/37 SP; 93/38; 93/55

[58] Field of Search ..... 93/37 R, 37 SP, 38, 93/55, 36.01; 53/185

[56] References Cited

U.S. PATENT DOCUMENTS

| | | | |
|---|---|---|---|
| 3,134,308 | 5/1964 | Ali-Oglu | 93/37 SP |
| 3,473,447 | 10/1969 | Ullman et al. | 93/37 SP X |
| 3,605,572 | 9/1971 | Derderian | 93/37 R |
| 3,803,993 | 4/1974 | Graham | 93/38 |
| 3,952,633 | 4/1976 | Nakai | 93/37 R |
| 3,978,773 | 9/1976 | Pinto | 93/37 SP |

*Primary Examiner*—Leon Gilden

*Attorney, Agent, or Firm*—Kolisch, Hartwell, Dickinson & Stuart

[57] ABSTRACT

Apparatus for forming a partition from a flat blank of material and inserting it into a container includes a forming assembly for bending the blank about a pair of preselected spaced-apart bend lines and for also folding the blank about a preselected central fold line. An "H" partition is thereby formed and it is introduced into a container. The introduction is facilitated by gate members which contact the container and provide a "funnel" through which the partition is directed.

15 Claims, 18 Drawing Figures

PARTITION FORMING AND INSERTING APPARATUS

BACKGROUND AND SUMMARY OF THE INVENTION

The present invention relates generally to packaging apparatus, and more particularly to an apparatus for forming a partition from a flat blank into a folded partition of predetermined configuration and inserting the partition into a container.

Containers such as boxes or cartons of cardboard or other material are commonly used for holding goods and products during shipment, storage, etc. Such containers may tend to be somewhat nonrigid and, therefore, easily deformed. Therefore, it is common practice to insert a partition into the container to provide a strengthening member or rib. Generally, the partitions extend between sides of the container and occupy a central location thereof. The partition may extend substantially the height of the container and be provided with flange or flap portions which are bent to provide further strengthening support. A so-called "H" shaped partition has been found to be particularly effective.

Container partitions are generally manufactured in flat blanks having score or fold lines which predetermine the manner in which the blank is to be folded to form a partition. The flat blanks come in bundles and it is necessary to separate a blank from the bundle and fold it prior to insertion into a container.

Prior art devices for folding a flat blank and inserting it into a container having proved inefficient from the standpoint that cumbersome machinery is required to effectuate the required fold. In addition, prior art apparatus have proved ineffective in inserting a partition due to misalignment of the partition into the container. Such drawbacks greatly reduce the efficiency of a packaging operation and are, therefore, undesirable.

Accordingly, it is a general object of the present invention to provide an apparatus operable for selectively transferring a flat blank to a forming station and folding the blank about preselected fold lines so that a partition of so-called "H" configuraton is formed. The partition is then shifted downwardly through a guide means through the open end of a container.

Another object of the present invention is to provide apparatus for accurately folding the flat blank about preselected bend or fold lines without the use of internal supports about which the blank is folded. Thus, simplicity and ease of operation are ensured with the present invention.

Still another object of the present invention is to provide a guide means including gate members which are selectively operable for engaging open edge portions of a container and providing an inclined surface over which the partition, during insertion, may be "funneled" in order to facilitate entry thereof. With such a construction, it is not necessary to overfold the partition in order to ensure entry into the container.

These and other objects and attendant advantages of the present invention will become more readily apparent from a consideration of the following drawings and the accompanying detailed description of a preferred embodiment.

DETAILED DESCRIPTION OF THE PREFERRED EMBODIMENT

Figure 1:
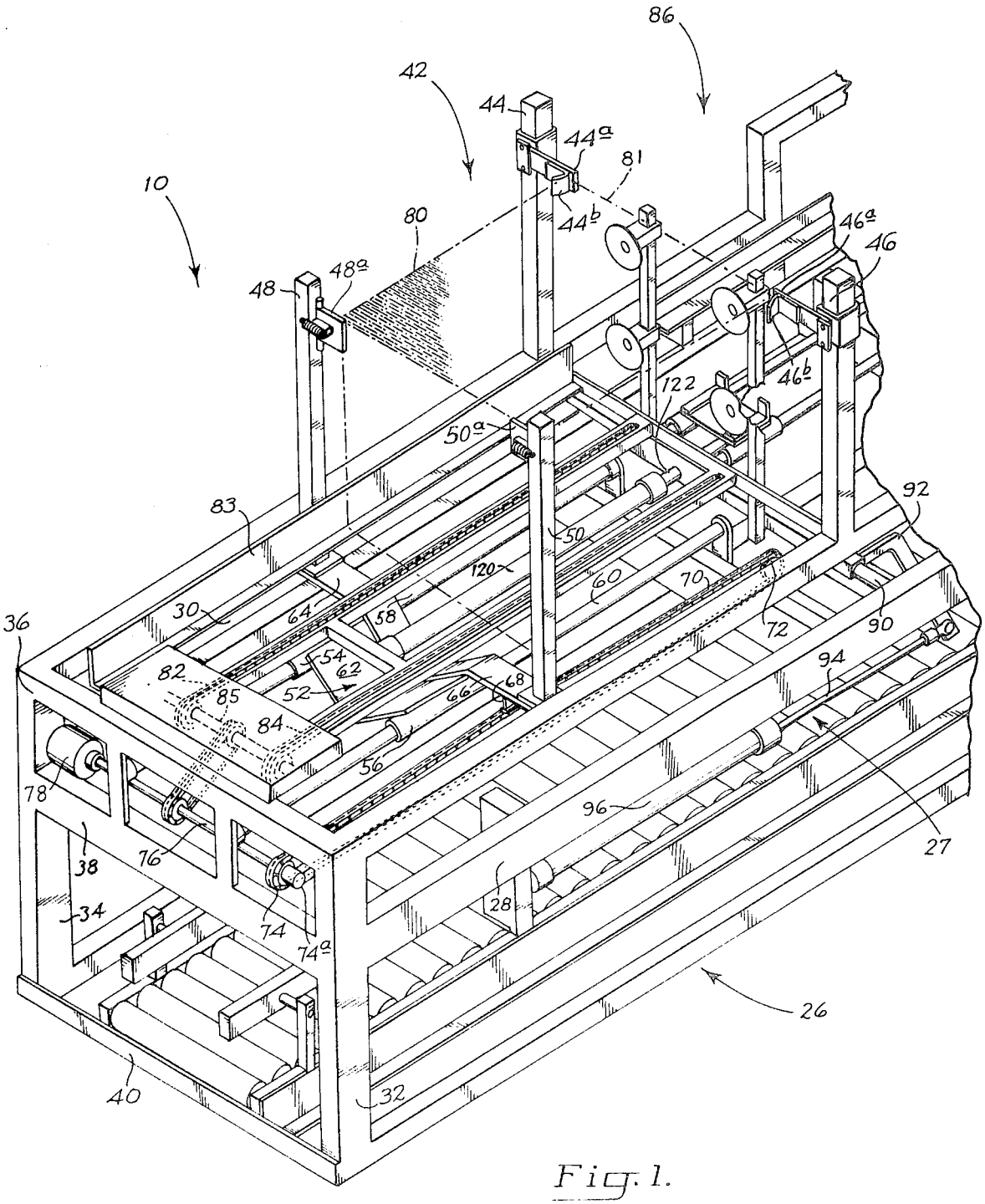
FIG. 1 is a perspective view of approximately one-half of an apparatus according to the present invention viewed from a position adjacent the top, with flat blanks being shown in dot-dash outline.

Referring initially to FIG. 1 of the drawings, there is indicated generally at 10 an apparatus for forming a partition from a flat blank of material and inserting it into a container. Before a detailed description of the apparatus is undertaken, it is felt necessary to generally describe the forming steps required to be performed on a flat blank of material in order to provide a folded partition of predetermined configuration. These steps are shown generally in FIG. 2.

Figures 2, 3, 14:
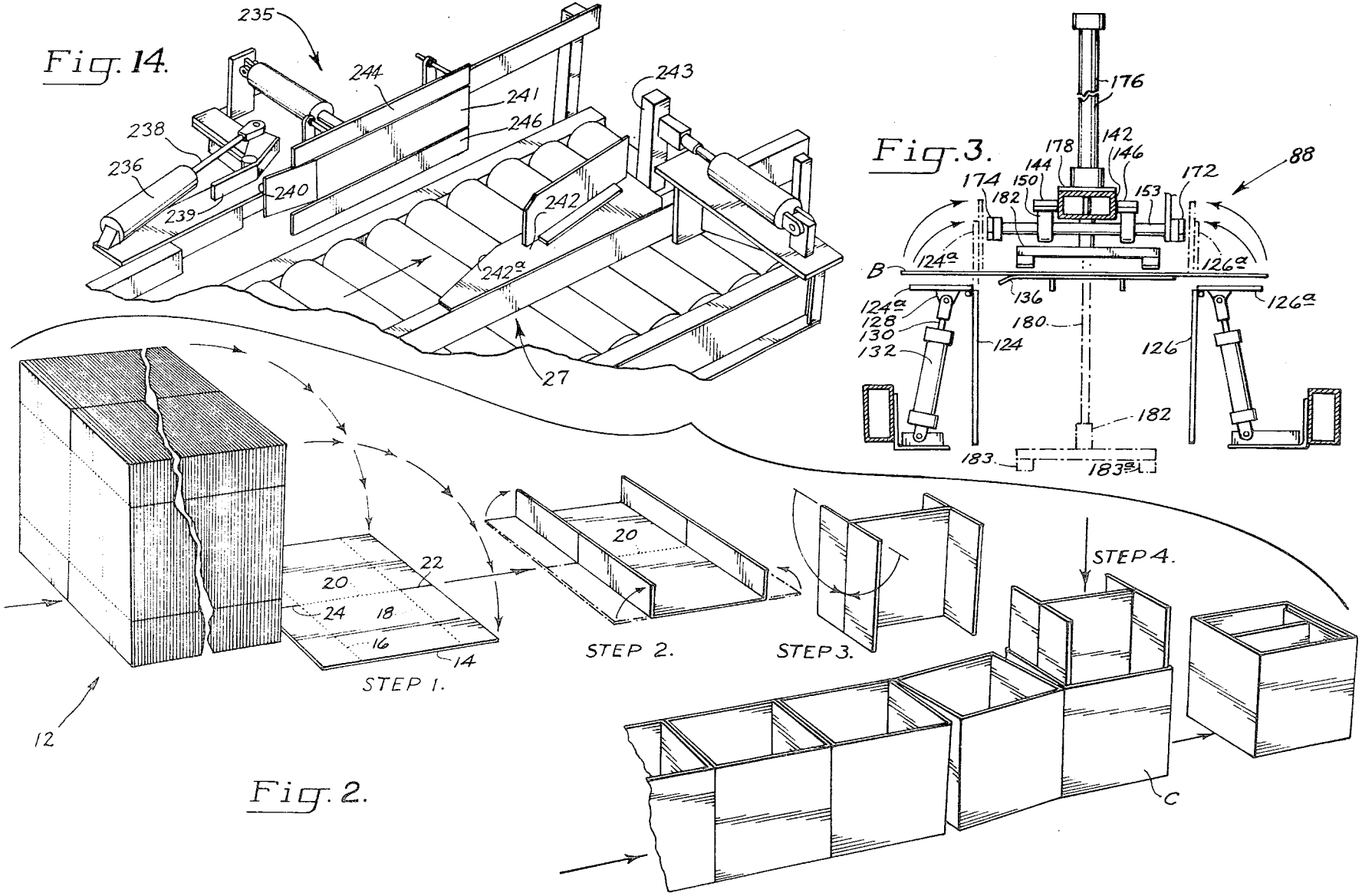
FIG. 2 is a perspective view illustrating the sequential steps required to bend and fold a flat blank into a partition of predetermined configuration, the steps being illustrated without the corresponding mechanical structure required to perform such steps.
FIG. 3 is a side view of a partition forming assembly of the apparatus with the frame structure deleted for purposes of clarity.
FIG. 14 is a perspective view of a portion of a conveyor used to transport containers in the apparatus and further illustrates a container orienting assembly.

As shown in FIG. 2, flat blanks ar generally supplied in a so-called stacked "bundle" 12. In order to prepare a blank for insertion into a container, a blank must first be separated from bundle 12. As shown, a blank 14 has been pivoted downwardly in the direction of the arrows into a substantially horizontal position. Blank 14, as are all the other blanks, is provided with preformed score lines for facilitating bending or folding. Such score lines may be perforated, grooved, etc. As shown, a pair of score lines are spaced apart and extend generally parallel to one another to represent preselected fold or bend lines 16, 18. Another score line extends substantially perpendicular to bend lines 16, 18 and defines a preselected central fold line 20. Extending from opposite ends of central fold line 20 are slits 22, 24.

As shown in step 2 in FIG. 2, marginal flap portions are formed by bending blank 14 about bend lines 16, 18. Step 3 indicates that blank 14 is folded about central fold line 20 in the direction of the illustrated arrows so that a folded partition having an "H" configuration is formed. Step 4 illustrates the insertion of the folded partition into a container C. Container C is merely one of a string of containers being conveyed beneath a forming station which forms the folded partitions from flat blanks and inserts them into successive containers.

With the above general description in mind, a detailed description of the present invention will now be set forth. As shown in FIG. 1, apparatus 10 includes a frame structure generally indicated at 26. Frame structure 26 includes multiple tubular members suitably connected together in a box-like structure. Longitudinally extending frame members 28, 30 are connected to upright members 32, 34 at one end thereof and similar upright members at the opposite end. Laterally extending frame members such as those shown at 36, 38 and 40 tie the structure together. It can be appreciated from a consideration of FIG. 1 that there are a plurality of other frame members not requiring detailed designation at this point.

A power-driven conveyor means, generally indicated at 27, is mounted on frame structure 26 and is selectively operable for transporting containers. Conveyor means 27 is constructed with a plurality of rollers arranged as illustrated.

Further considering FIG. 1, it can be seen that a hopper assembly, generally indicated at 42, includes fixed, upright members 44, 46 connected to frame structure 26 and movable upright members 48, 50 connected to a carriage assembly generally indicated at 52. Carriage assembly 52 includes a pair of sleeves 54, 56 which are slidably mounted on tubular guide members 58, 60 respectively. Guide members 58, 60 are appropriately secured to frame structure 26 and longitudinally extend from a position adjacent the rear of the structure to a position somewhat adjacent upright members 44, 46 as shown.

Sleeves 54, 56 are interconnected by a V-shaped plate 62. Mounted to plate 62 are connecting members 64, 66 which are secured to upright members 48, 50 respectively. Mounted beneath member 66 is a plate 68 connected to opposite ends of a hopper drive chain 70. Chain 70 is mounted on sprockets 72, 74 which are journaled to frame structure 26. Sprocket 74 is connected by means of an air clutch **74*a* to a drive shaft 76. Drive shaft 76 is suitably driven by a motor 78** which includes a gear reducer.

Figure 13:
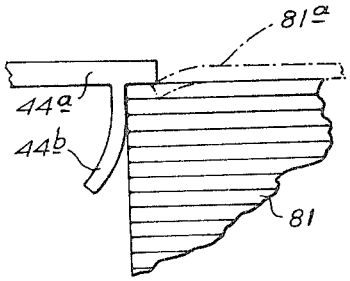
FIG. 13 is a partial view of a retaining member utilized to hold a lead blank.

As shown in FIG. 1, a stack or bundle of flat blanks is generally indicated at 80 in dot-dash. As will become more apparent as this description continues, lead blanks will be successively separated from the bundle. For instance, a lead blank is shown at 81 and has its upper edges supported against retainer portions of arms **44*a*, 46*a*, which extend laterally from uprights 44, 46 respectively. A curved guide member 44*b* tends to align a lead blank against arm 44*a*. A similar curved member is provided on arm 46*a*. A detail of this construction and its interrelationship to the blanks is shown in FIG. 13**.

A bottom edge of the uprightly disposed blanks is supported upon additional chains 82, 84 which are suitably mounted in longitudinally extending guide members. Chains 82, 84 are connected by means of a drive and jack shaft 85 from shaft 76 so that they are advanced simultaneously with chain 70. As chain 70 is advanced, air clutch **74*a* permits carriage assembly 52 to apply substantially even pressure through uprights 48, 50 bearing against the bundle. Chains 82, 84 facilitate movement of the blanks by urging bottom edges of the blanks in a forward direction as successive lead blanks are separated from the bundle. Spring loaded gates 48*a*, 50*a* are provided on movable uprights 48, 50 in order to urge the blanks together and form a relatively compact stack. A side guide rail is shown at 83 and is secured to frame structure 26**.

With attention directed to FIGS. 1 and **1*a*, details of a transfer assembly, generally indicated at 86, will now be described. Transfer assembly 86 is provided to separate a lead blank, position it in a substantially horizontal position and transfer the blank to a forming means or assembly generally indicated at 88. The transfer assembly includes an elongate pivot bar 90 which extends transversely of frame structure 26 and is appropriately journaled in longitudinal frame members 28, 30. An angled link 92 is connected at one end thereof to pivot bar 90 and has its other end connected to an extendible-retractable rod 94. Rod 94 is actuated by means of a fluid-powered cylinder 96. Cylinder 96 is appropriately mounted on frame structure 26**.

A pair of opposed, spaced-apart pivot arms 98, 100 are rigidly connected at one set of their ends to pivot bar 90. Pivot bar 90 is provided with a flat surface to accommodate such connection. Mounted on pivot arms 98, 100 are suction or vacuum cup assemblies such as shown at 102. One of the vacuum cup assemblies has been removed from pivot arm 100 in order that additional details to be described hereinafter can be shown with clarity. Each of the vacuum cup assemblies includes an orifice, such as shown at 103 which extends through a mounting bracket to an appropriate vacuum source by means of flexible, tubular hoses (not shown).

Thus, it can be appreciated that pivot arms 98, 100 are selectively operable for positioning against a lead blank so that the vacuum cup assemblies will attach to such blank. Upon retraction of rod 94, pivot arms 98, 100 will swing or pivot downwardly and pull the edges of a lead blank through the retainer portion on arms **44*a*, 44*b*. As shown in FIG. 13, a blank 81*a*, shown in dot-dash, is being so pulled. Rod 94 is retracted to the point where a lead blank is substantially horizontally positioned and supported upon ledges 104, 106 of transfer assembly 86**. Such a blank is shown in dot-dash outline.

As shown in FIG. **1*a*, support ledges 104, 106 are provided with guide rails 104 a, 106*a*, respectively, which extend in the longitudinal direction of frame structure 26 and are spaced-apart in substantially parallel position. Transfer assembly 86 also includes a shiftable assembly generally indicated at 108 which includes a plate 110 mounted on sleeves 112, 114. Sleeves 112, 114 are slidably mounted on elongate, longitudinally extending guide rods 113, 115, respectively, for selective movement in a direction toward forming assembly 88. Shiftable assembly 108 may also be returned. Upwardly extending fingers 116, 118 are provided on plate 110 for contacting a rear edge of a lead blank positioned on ledges 104, 106**.

A power-actuated cylinder 120 is disposed behind shiftable assembly 108 and is appropriately secured to frame structure 26. Cylinder 120 includes an extendible-retractable rod 122 which extends through a transversely extending frame member for connection to plate 110. Thus, upon extension of rod 122, shiftable assembly 108 will be extended toward forming assembly 88 so that fingers 116, 118 may contact a rear edge of a blank and push the blank forwardly toward forming assembly 88.

Figure 1A:
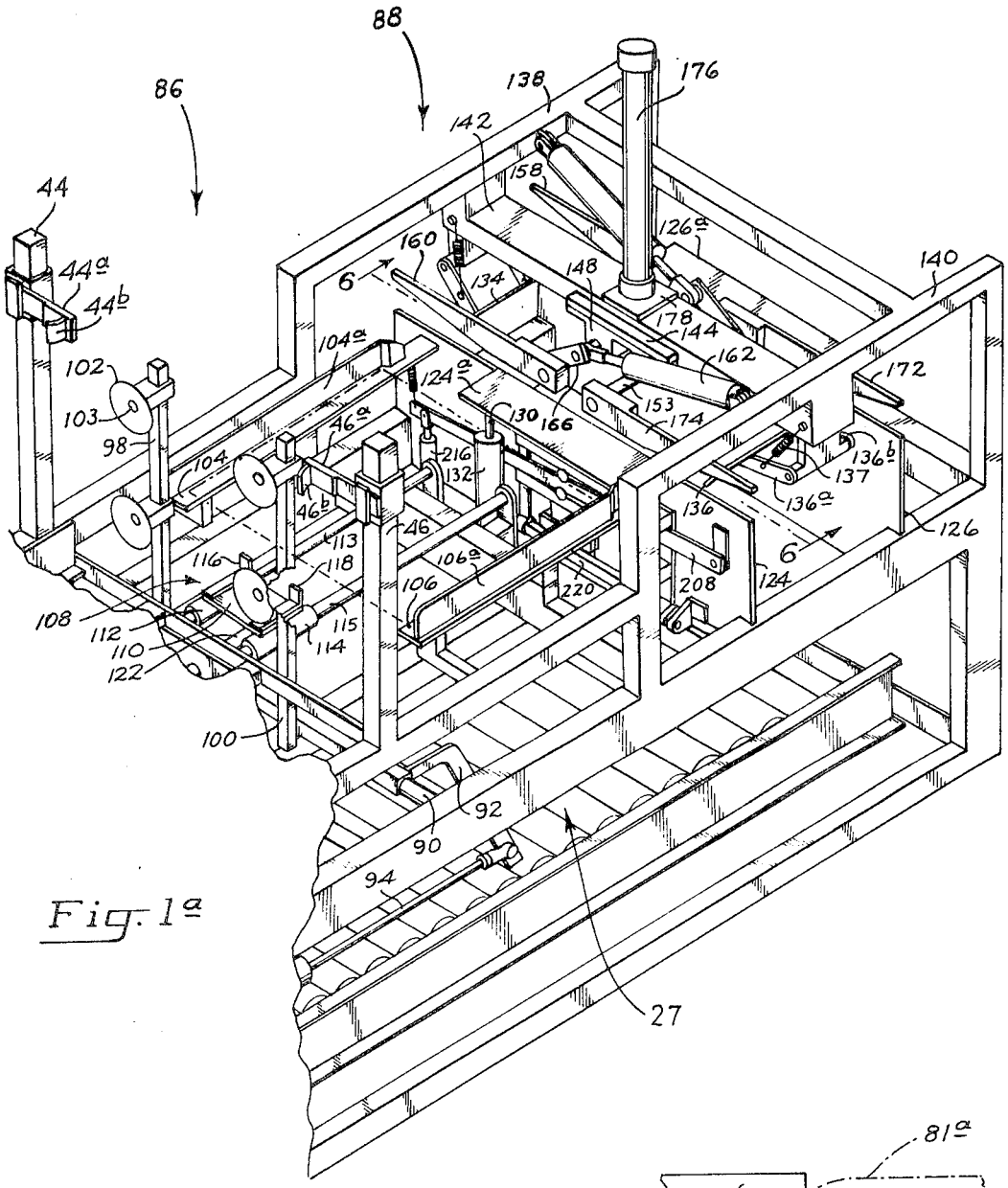
FIG. 1*a* is a perspective view of the other half of the apparatus.

Turning now to details of forming assembly 88, it can be seen from a consideration of FIGS. 1*a* and 3 that a pair of opposed, transversely extending chute walls 124, 126 are positioned downstream of transfer assembly 86. The top of walls 124, 126 are disposed slightly below the top of ledges 104, 106. Additionally, walls 124, 126 include plate members 124*a*, 126*a*, respectively, which are pivotally connected to an associated wall adjacent a top portion thereof. Considering FIG. 3, it can be seen that each plate member is connected to an actuating cylinder. For instance, plate member 124*a* includes a bracket 128 which is connected to one end of an extendible-retractable rod 130. Rod 130 is actuated by means of a suitably positioned fluid-actuated cylinder 132. Similarly, plate member 126*a* is connected to a fluid-actuated cylinder and rod.

Still considering FIGS. 1*a* and 3, it can be seen that plate members 124*a*, 126*a* are initially positioned for underlying a blank B shifted from transfer assembly 86 to forming assembly 88. With the blank in such position, it can also be seen that a pair of support means or rods 134, 136 are provided for holding the blank in a substantially horizontal position. Rods 134, 136 are provided with downturned front portions so that transfer of a blank will not be impeded. With the blank so held, plate members 124*a*, 126*a* serve as a first means selectively operable for bending the blank. Specifically, plate members 124*a*, 126*a* are pivoted by their respective cylinder and rod assemblies from an initial position underlying the blank to a final, upright position for bending material flap portions about preselected fold lines, such as fold lines 18, 20 shown in FIG. 2. This is the step indicated as step 2 in FIG. 2 and is shown in dot-dash outline in FIG. 3.

With the marginal flap portions so formed, the blank is still supported on rods 134, 136. The next step is step 3 as shown in FIG. 2 and requires that side expanses of the blank be pivoted about central fold line 20 (see FIG. 2) so that the "H" partition will be formed. Details of the construction for folding the blank about the central fold line will now be described.

Figure 5:
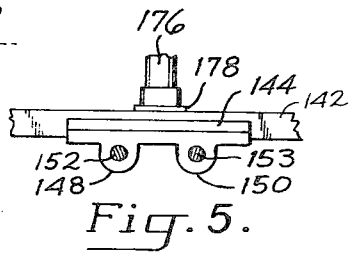
FIG. 5 is a view taken along lines 5—5 and illustrates further details of the folding arms.
Figure 4:
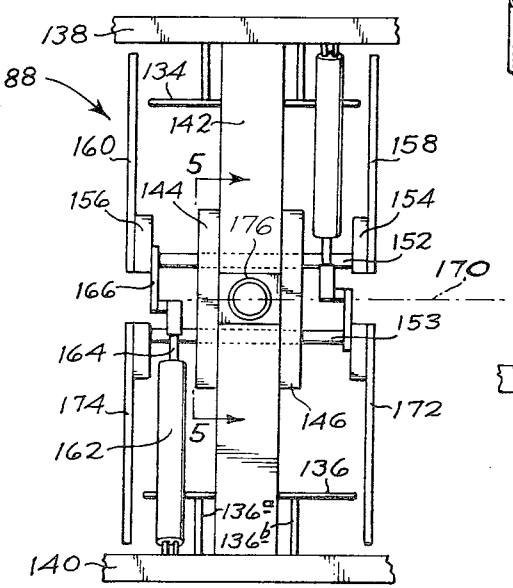
FIG. 4 is a top view of the forming station illustrating the positioning of folding arms.

Turning to FIGS. 4 and 5 as well as FIG. 1*a*, it can be seen that forming assembly 88 is provided with longitudinally extending frame members 138, 140 between which is disposed a transversely extending support member 142. Mounted on opposite sides of support member 142 are plates 144, 146 each of which serves as a mount for a pair of pillow blocks. For instance, considering FIG. 5, it can be seen that mounting plate 144 includes a pair of tandemly positioned pillow blocks 148, 150 mounted to an under side thereof. Similarly, mounting plate 146 includes a pair of tandemly positioned pillow blocks, each of which has a bearing mounted with its rotational axis aligned with a corresponding pillow block on mounting plate 144. Extending through each aligned pair of pillow blocks is a rotatable shaft such as shafts 152, 153.

At opposite ends thereof, shaft 152 is keyed or otherwise suitably connected to bars 154, 156. A pair of elongate folding arm means such as arms 158, 160 are mounted to bars 154, 156, respectively. Arms 158, 160 are pivotal about the longitudinal axis of shaft 152 by means of a fluid-actuated cylinder 162 which includes an extendible-retractable rod 164. An end of rod 164 is pivotally connected to a link member 166, an opposite end of which is rigidly connected to bar 156. It should also be noted that cylinder 162 is pivotally connected to frame 140 as shown at 168.

Similarly, shaft 153 is provided with a pair of folding arm means such as arms 172, 174 which are actuated by a fluid-actuated cylinder and rod assembly. It is to be noted that the center line 170 positioned parallel and midway between the longitudinal axes of shafts 152, 153 will be substantially aligned with the central fold line of a blank when the blank is positioned in forming assembly 88.

The folding arm means provide a second means selectively operable for folding the blank about the preselected central fold line. Details of the folding step (step 4) will be described at a later point. Each of folding arms 158, 160, 172 and 174 is provided with an inclined surface, such as surfaces 160*a* and 174*a* shown in FIG. 6.

With reference directed to FIGS. 1*a* and 3, there is shown a fluid-actuated cylinder 176 vertically mounted on support member 142 by means of a plate 178. An extendible-retractable rod 180 extends through appropriately aligned apertures in support member 142. Connected to an end of rod 180 is a bar 182 which is substantially axially aligned with aforementioned center line 170. Bar 180 is provided with finger assemblies 183, 183*a*, which will position about the crease formed about central fold line 20 during insertion step 4. Cylinder 176 and bar 182 comprise an inserting means selectively operable for engaging a folded blank or "H" partition adjacent to the central fold line and shifting the partition in a direction generally perpendicular to the fold line and introducing it into a container beneath the folding assembly.

Figure 6:
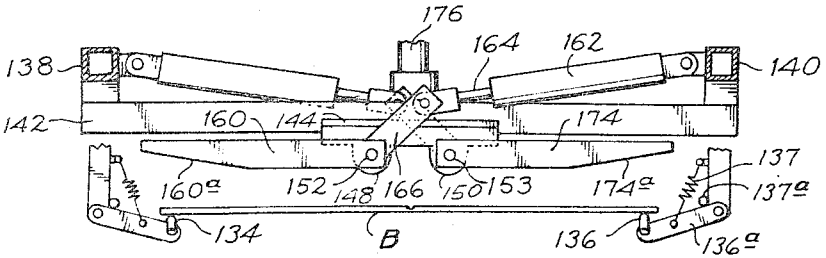
FIG. 6 is a front view of a portion of the forming assembly taken along lines 6—6 of FIG. 1*a* and illustrates a flat blank prior to bending and folding steps.

Turning briefly to FIG. 6, it is to be noted that support rods 134, 136 are each mounted so that they can be pivoted out of the way during a folding operation. For instance, rod 136 is rigidly mounted on a pair of pivot arms 136*a*, 136*b* which in turn have one set of their ends pivotally connected to the frame structure. A biasing means 137 urges arms 136*a*, 136*b* and rod 136 so that the rod assumes a normally horizontal position. A stop or limit member is indicated at 137*a* for maintaining such horizontal position. The need for swinging or pivoting movement of arms 136*a*, 136*b* is apparent because side expanses of the blank are urged toward each other during the folding step.

With particular attention directed to FIGS. 11 and 12, additional features of the present invention will now be described. As noted previously, a principle feature of the present invention resides in the fact that guide means are provided for holding a container and providing an inclined surface for a folded partition to engage so that the partition will readily slide or be "funneled" into the container. This is shown somewhat schematically in FIG. 10 and sequentially in FIGS. 15, 15*a* and 15*b* wherein a folded or "H" style partition P is being shifted downwardly between chute walls 124, 126 into container C. A pair of gate members 184, 186 are shown inclined and partially disposed within container C to provide a surface over which leading edges of the downwardly descending partition may contact and, therefore, be guided into the container. When the partition is completely inserted in the container, gate members 184, 186 will be pivoted upwardly so that the container may be advanced and the next succeeding container be positioned therebeneath.

Figures 11, 12, 15, 15A, 15B:
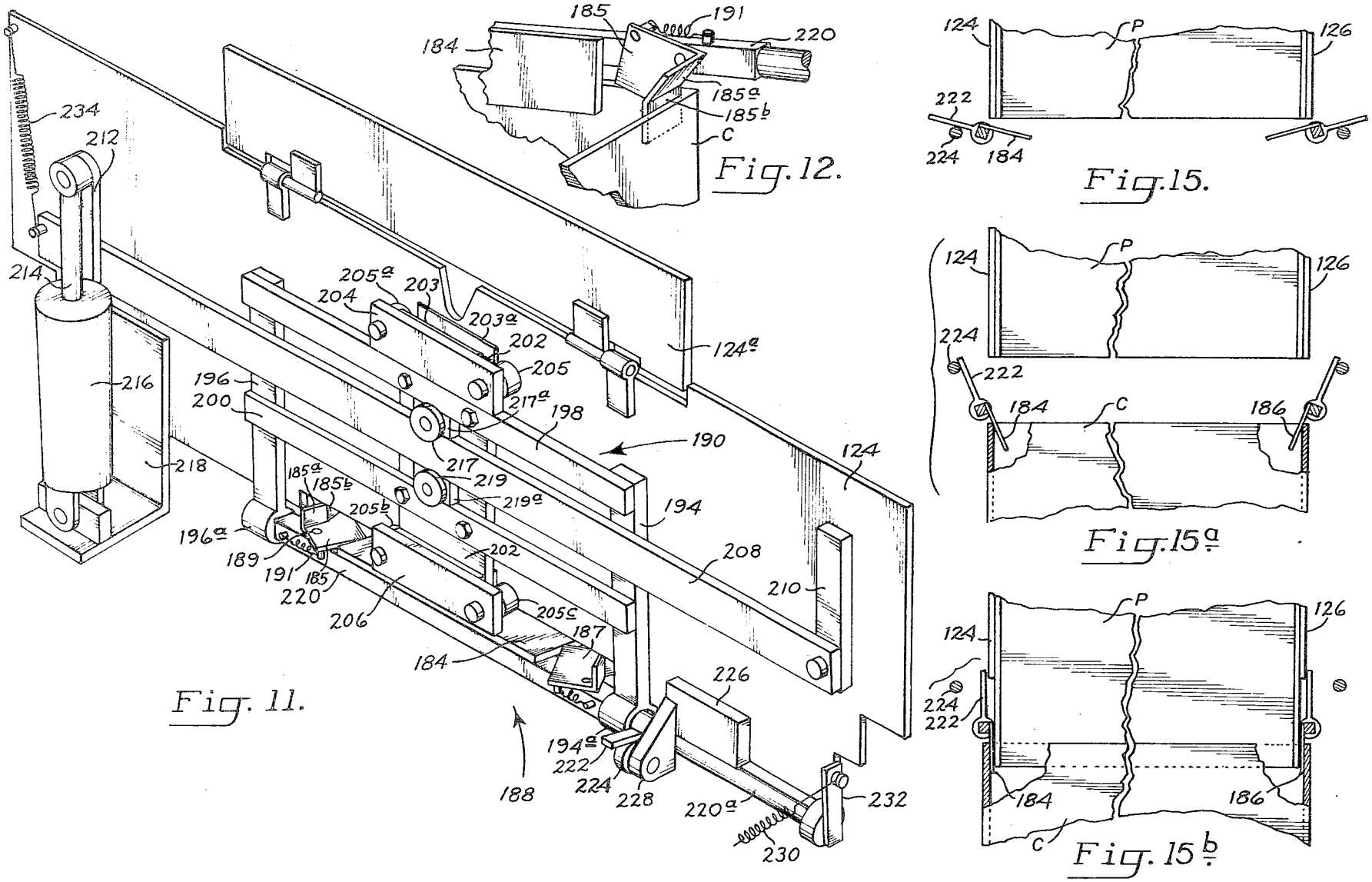
FIG. 11 is a perspective view of a guide assembly including gate members provided for guiding a partition into a container.
FIG. 12 is a partial view of a container showing positioning of the gate members during an inserting operation with other structure being deleted.
FIGS. 15, 15*a* and 15*b* are views similar to FIG. 10 illustrating, in sequence, the guiding of a partition by the gate members into a container.

Considering FIG. 11, only chute wall 124 is shown in detail with gate member 184 in a nonguiding or raised position. Wall 126 comprises substantially the same structure. The actuating cylinder for pivotally moving plate member 124*a* is not illustrated so that details of a guide means, generally indicated at 188, may be more clearly described. Guide means 188 is mounted on wall 124 and includes a frame assembly indicated at 190. Frame assembly 190 includes upright members 194, 196 which are rigidly interconnected by transversely extending members 198, 200.

A slideable plate 202 is rigidly connected to members 198, 200 and is retained adjacent an outer side of wall 124 by guide plates 204, 206. Each of the guide plates includes a bearing surface such as surface 203 shown provided on plate 204. Plates 204, 206 are secured to wall 124 and include a pair of rollers (205, 205*a*, 205*b* and 205*c*) for facilitating vertical sliding movement of plate 202. Additionally, backing plates such as shown at 203*a* are provided as additional bearing surfaces for decreasing friction.

An elongate pivot arm 208 is pivotally connected to wall 124 by means of a bracket 210 and extends across wall 124. The other end of pivot arm 208 is connected to a link 212 which in turn is connected to an end of an extendible-retractable rod 214. Rod 214 is actuated by a double acting fluid-powered cylinder 216 which is mounted to wall 124 by a suitable bracket 218. It is to be noted that one end of cylinder 216 is pivotally connected to bracket 218 as shown.

A pair of retaining members such as circular washers or plates 217, 219 are connected through spacer blocks 217*a*, 219*a*, respectively to plate 202. Portions of plates 217, 219 overlap portions of pivot arm 208 so that the pivot arm is retained adjacent frame assembly 190. Thus, it can be seen that movement of pivot arm 208 about its pivot axis will transfer vertical movement to frame assembly 190 because the frame assembly is rigidly connected to slideable plate 202.

Each of upright members 194, 196 is provided with a bearing end such as end 194*a* on member 194 and end 196*a* on member 196. A flat-surfaced rotatable shaft 220 extends between bearings 194*a*, 196*a* and includes cylindrical shaft portions which are journaled in the bearings. Extending through an end of bearing 194*a* is a round shaft portion 220*a* on which is mounted an elongate cam plate 222. A stationary cam follower 224 is suitably mounted by means of bracket members 226, 228 to wall 124 for contact with cam plate 222.

A pair of corner gate members 185, 187 are pivotally connected to shaft 220 and are biased upwardly by a spring. For instance, corner gate member 185 is pivotally connected by a pivot pin 189 and is urged upwardly by a spring 191. Each of the corner gate members has guiding surfaces such as surfaces 185*a*, 185*b* shown on corner gate member 185 (see FIG. 12).

A spring 230 is connected to an arm and sleeve assembly 232 and to the frame structure. Spring 230 rotates shafts 220 and 220*a* so that cam plate 222 is urged against cam follower 224 when rod 214 is in its extended position. A spring 234 is connected to an end of arm 208 as well as to chute wall 124 and normally holds arm 208 in an upward position.

With reference directed to FIGS. 15, 15*a* and 15*b* as well as FIG. 11, it can be seen that retraction of rod 214 swings pivot arm 208 so that frame assembly 190 is shifted vertically downwardly. As shafts 220, 220*a* move downwardly, cam plate 222 rides over cam follower 224 and rotates the shafts about their longitudinal axes. The rotation swings gate member 184 into position for contacting an inside edge portion of container C conveyed beneath the chute walls and partition P. Gate member 184 is swung to an inclined position and insertion of partition P further rotates shafts 220, 220*a* so that gate member 184 in effect provides a movable "funnel" for guiding the partition. Similarly, gate member 186 provides a guiding surface and partition P is accurately guided into container C without the possibility of being impeded.

As partition P is shifted downwardly, it slideably engages the corner gate members as well as inclined gate members 184, 186 and is "funneled" into the container as shown in FIG. 15*b*.

The inclined surfaces of the corner gate members engage leading corner edges of the marginal flap portions of the partition as it is inserted into the container. As shown in FIG. 12, corner gate member 185 has been swung downwardly against the action of spring 191 into a corner of container C by an inserted partition (not shown). After the partition has been inserted into the container, rod 214 is extended so that the gate members pivot upwardly to permit the container (with an inserted partition) to move downstream. A new container is then positioned beneath the forming assembly and the process is repeated.

OPERATION

In considering operation of apparatus 10, it is to be understood that the various steps described are operated in sequence. Therefore, electrical and hydraulic circuitry compatible with such sequences is suitably provided on the apparatus, though not specifically illustrated in order to retain clarity of the drawings. In order to fully appreciate the sequential operation, reference should also be made to FIG. 2.

As shown in FIG. 1, a bundle of blanks as indicated at 80 is loaded within hopper assembly 42. Cylinder 96 is actuated to extend rod 94 so that arms 98, 100 are pivoted to permit contact of the suction cup assemblies against an outwardly facing surface of lead blank 81. Suitable suction force is applied to the lead blank through vacuum cup assemblies 102 so that a strong retaining grip is ensured. Rod 94 is retracted within cylinder 96 and pivot arms 98, 100 are pivoted downwardly so that the lead blank is peeled from the bundle. (Motor 78 is continuously operating so that the bundle is moved forwardly by means of chains 82, 84 and carriage assembly 52. Air clutch 74*a* is provided with the motor to disengage it from shaft 76 as required).

Pivot arms 98, 100 are pivoted to a position wherein side edges of the blank rest upon ledges 104, 106 in transfer assembly 86. At this point, the suction forces are diminished and shiftable assembly 108 is actuated from its return position (as shown in FIGS. 1 and 1*a*) so as to shift the flat blank into forming assembly 88 until the blank rests upon horizontally positioned underlying plate members 124*a*, 126*a*, and support rods 134, 136. Shiftable assembly 108 is then retracted to its return position.

Figure 7:
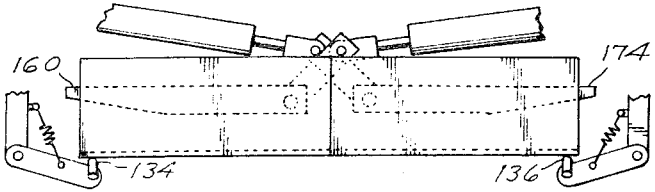
FIG. 7 is a view similar to FIG. 6 illustrating the blank with marginal end portions bent upwardly.

As shown in FIGS. 3, 4 and 6, folding arms 158, 162, 172 and 174 are in their prefolding or substantially horizontal positions. Plate members 124*a*, 126*a* are then pivoted from their initial position underlying the blank to a final upright position for bending marginal flap portions about preselected fold lines such as fold lines 16, 18 as shown in FIG. 2. The blank now includes upwardly extending side or marginal flap portions as shown in the view illustrated in FIG. 7.

Figure 8:
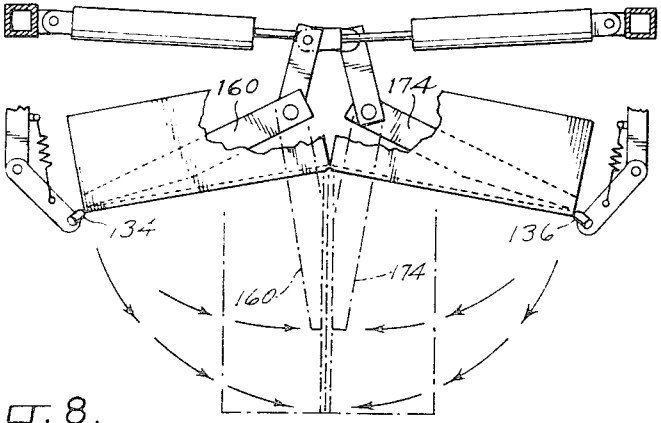
FIG. 8 is a view similar to FIGS. 6 and 7 illustrating actuation of the folding arms to effectuate a fold about a central fold line, completion of the fold being shown in dot-dash outline.

The next step corresponds to step 3 as shown in FIG. 2 and can be best understood from a consideration also of FIG. 8. The plurality of folding arm means such as arms 160, 174 shown in FIG. 8 are simultaneously pivoted by their respective cylinders so that the inclined surfaces of the arms initiate contact or engagement on the blank on opposite side expanses of the central fold line for simultaneously urging the expanses toward each other. The final position of the arms is indicated in dot-dash outline in FIG. 8 and shows the folded partition as it is held prior to being inserted into a container disposed therebeneath.

It should be noted that during the folding of the blank about the central fold axis into its collapsed or folded configuration, support rods 134, 136 are pivoted outwardly to accommodate the folding. It has been found unnecessary to provide any inner support of the blank about which it is to be folded. In other words, arms 158, 160 and 172, 174 acting in unison provide sufficient and rapid enough folding motion to maintain contact and grip the folded partition in its final folded configuration. The inclined surfaces on the arms ensure that sufficient area is provided for holding the folded partition.

At this point, a container has been positioned beneath forming assembly 88 by conveyor means 27. Gate members 184, 186 have been appropriately positioned over edges of the container so as to be inclined relative thereto. The gate members also serve to maintain the container in substantially rigid position beneath forming assembly 88. As shown in FIG. 2, the line of containers may be slightly shifted to one side so that a receiving container is disposed directly underneath the forming assembly.

The positioning of a container can best be understood from a consideration of FIG. 14, which illustrates details of a container orienting means or assembly, generally indicated at 235 and disposed beneath forming assembly 88. Conveyor means 27 is a two-speed conveyor and includes a plurality of rollers which are rotatably journaled in the frame structure and suitably power driven. A fluid-actuated cylinder 236 is mounted adjacent to a frame member and includes an extendible-retractable rod 238 pivotally connected to a pivotal gate 239. The gate is selectively operable for swinging a portion of its length inwardly above an inclined plate 240 mounted on the frame structure. In such position, an upstream container will contact the gate and be prevented from forward travel.

A positioning member having an outwardly bent portion is shown at 241 and another positioning member is shown at 242. The positioning members are suitably mounted to the frame structure on opposite sides of the rollers. Positioning member 242 includes a tapered surface **242*a* which tends to guide a container into contact with positioning member 241. At a downstream end of conveyor means 27 is disposed a stop means 243** selectively operable (by means of a cylinder/rod assembly) for engaging the front end of a container and preventing it from movement in the forward direction.

A pair of elongate shoes 244, 246 are mounted along the top and bottom edges of positioning member 241 and are selectively operable for movement inwardly toward the rollers for contact against a container so that the container will be rigidly held against positioning member 242. A suitably provided fluid-actuated cylinder and rod assembly, generally designated at 248, is utilized for displacing shoes 244, 246.

Thus, in order for a container to be oriented beneath forming assembly 88 for the position shown in step 4 (FIG. 2), the following sequence is provided. Gate 239, shoes 244, 246 and stop means 243 are initially disposed in their retracted positions, and as a container engages tapered surface **242*a*, it is skewed off the center of travel as shown in FIG. 2. Stop means 243 is then positioned in front of the container to prevent forward travel. As soon as a rear side of the container moves forwardly beyond plate 240, gate 239 is swung into position to prevent contact by the upstream containers. Shoes 244, 246 are then actuated inwardly against a side of the container so that it is urged against positioning member 242. The container is now held in a predetermined, oriented position beneath forming assembly 88** and is precisely disposed for receiving a partition. After receiving a partition, the container is permitted to move forwardly and the process is repeated.

Figure 10:
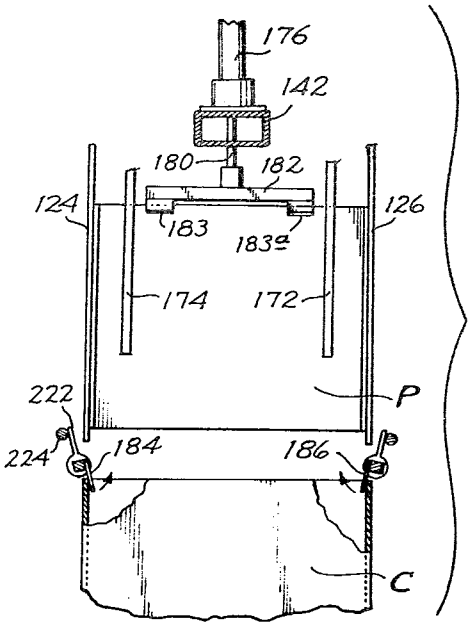
FIG. 10 is a side view of FIG. 9 with the addition of a container being shown below the folded partition prior to the partition being inserted thereinto.
Figure 9:
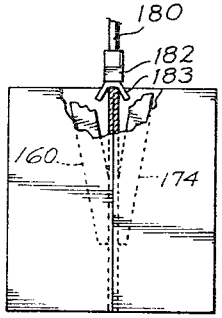
FIG. 9 is a view similar to FIG. 8 with portions cut away illustrating an inserting mechanism contacting the central fold line.

The inserting means including cylinder 176, rod 180 and bar 182 is then actuated from its pre-inserting position to a downwardly extending position to contact the crease formed along the central fold line. This is illustrated in FIGS. 9 and 10 and insertion of the folded blank, as it slips through the folding arm means, is ensured by the guiding action of gate members 184, 186 and corner gate members 185, 187 (see also FIGS. **11, 12, 15, 15*a* and 15*b***).

Upon complete insertion of partition P, gate members 184, 186 and **185, 185*a* are pivoted upwardly to permit the container to advance down the conveyor line so that a subsequent container may be positioned under forming assembly 88**.

From the above, it can be appreciated that the present invention provides several notable features in forming an "H" partition and inserting it into a container. For instance, accurate bending of marginal flap portions is provided by plate members **124*a*, 126*a***. Additionally, provision of the folding arm means as described ensures that rapid, complete folding of the partition about a preselected central fold line will result. No forming support is required to be placed under the blank about which it is to be folded during the folding step.

The pivotally mounted support bars provide temporary support but are easily displaced out of the way during operation of the folding arm means. It is also to be noted that the guide means holds a container as well as provides gate members for directing entry of a folded partition into the container. Because the gate members are positioned to fit within the container at an incline, a "funnel" is provided which accurately guides entry of a partition. It has been found that almost fool-proof insertion of partitions results from the use of such a guide means.

Additional advantages of the present invention reside in the construction of the transfer assembly which utilizes pivotal arms having vacuum cup assemblies for attachment to a lead blank. A lead blank is horizontally positioned in an efficient movement upon ledges and a shiftable assembly accurately and precisely shifts the blank into operative position on the forming assembly.

Furthermore, the container orienting assembly precisely orients a container beneath the forming assembly so that a folded partition may be inserted. The orienting assembly includes means for slightly skewing a container from the upstream direction of travel and further includes shoes for rigidly holding the container against a positioning member.

While the invention has been shown and described with reference to the foregoing preferred embodiment, it will be understood by those skilled in the art that other changes in form and detail may be made without departing from the spirit and scope of the invention as defined in the appended claims.

It is claimed and desired to secure by Letters Patent:

1. Apparatus for forming a partition from a flat blank of material and inserting it into a container comprising:

support means for holding the blank in a substantially horizontal position;

forming means disposed adjacent said support means selectively operable for forming the blank into a folded partition of predetermined configuration, said forming means including first and second means, said first means being selectively operable for bending the blank about a pair of preselected, spaced-apart fold lines to form opposed, marginal flap portions, said second means being selectively operable for additionally folding the blank about a preselected central fold line generally perpendicular to said spaced-apart fold lines, said second means including a plurality of folding arm means mounted above said support means selectively operable for engaging the blank on opposite side expanses of said central fold line and simultaneously urging said expanses toward each other; and inserting means disposed adjacent said forming means selectively operable for shifting and introducing the folded partition into the container through an open end thereof.

2. The apparatus of claim 1 wherein said first means includes opposed members pivotally connected adjacent said support means selectively movable between an initial position underlying the blank and a final, substantially upright position for bending said marginal flap portions about their preselected fold lines.

3. The apparatus of claim 1 wherein said inserting means includes extendible-retractable means selectively operable for engaging the folded partition adjacent its central fold line and shifting the folded partition in a direction generally perpendicular to said central fold line.

4. The apparatus of claim 3 wherein guide means are mounted beneath said support means operable for selectively engaging open edge portions of the container and providing an inclined surface for directing entry of the folded partition into the container.

5. The apparatus of claim 4 wherein said guide means includes pivotally mounted gate members movable between a position partially within the container and a position outside of the container.

6. Apparatus for forming a partition from a flat blank of material and inserting it into a container comprising:

a frame structure;

conveyor means mounted on said frame structure selectively operable for transporting containers;

transfer means disposed above said conveyor means operable for selectively separating a lead blank from a bundle of flat blanks and positioning it substantially horizontally;

support means disposed above said conveyor means for receiving a lead blank and holding it in a substantially horizontal position;

forming means disposed adjacent said support means selectively operable for forming a lead blank into a folded partition of predetermined configuration, said forming means including first and second means, said first means being selectively operable for bending the blank about a pair of preselected, spaced-apart fold lines to form opposed, marginal flap portions, said second means being selectively operable for additionally folding the blank about a preselected central fold line generally perpendicular to said spaced-apart fold lines, said second means including a plurality of folding arm means mounted above said support means selectively operable for engaging the blank on opposite side expanses of said central fold line and simultaneously urging said expanses toward each other; and inserting means positioned adjacent said forming means operable for shifting and introducing the folded partition into the container through an open end thereof.

7. The apparatus of claim 6 wherein said first means includes opposed members pivotally connected adjacent said support means selectively movable between an initial position underlying the blank and a final, substantially upright position for bending said marginal flap portions about their preselected fold lines.

8. The apparatus of claim 6 wherein said folding arm means are mounted on opposed, rotatable shafts which have their longitudinal axes substantially parallel to each other.

9. The apparatus of claim 8 wherein said folding arm means have portions of their lengths inclined relative to the remaining portions.

10. The apparatus of claim 8 wherein extendible-retractable means is connected to each shaft for imparting rotation to each shaft about its longitudinal axis.

11. The apparatus of claim 8 wherein said support means is pivotally mounted on said frame structure for movement between a blank supporting position and a nonsupporting position after said folding arm means have urged said expanses toward each other a predetermined distance.

12. Apparatus for forming a partition from a flat blank of material and inserting it into a container comprising:

a frame structure;

conveyor means mounted on said frame structure selectively operable for transporting containers;

transfer means disposed above said conveyor means operable for selectively separating a lead blank from a bundle of flat blanks and positioning it substantially horizontally;

support means disposed above said conveyor means for receiving a lead blank and holding it in substantially horizontal position;

forming means disposed adjacent said support means selectively operable for forming a lead blank into a folded partition of predetermined configuration;

inserting means positioned adjacent said forming means selectively operable for shifting and introducing the folded partition into the container through an open end thereof; and guide means mounted beneath said support means operable for selectively engaging open edge portions of the container and providing an inclined surface for directing entry of the folded partition into the container, said guide means being mounted on chute walls extending downwardly from said support means and including pivotal gate members movable between a position partially within the container and a position outside of the container, said guide means also including corner gate members operable for selective engagement with corners of the container to facilitate entry of the corners of a folded partition into the container.

13. The apparatus of claim 12 wherein said gate members and corner gate members are mounted on an elongate member selectively rotatable for positioning said gate members.

14. The apparatus of claim 12 wherein orienting means are disposed beneath said forming means selectively operable for preventing movement of a container during insertion of the folded partition.

15. The apparatus of claim 14 wherein said orienting means includes a positioning member having a tapered surface for guiding the container into a predetermined position beneath said forming means.

* * * * *